US005503592A

United States Patent [19]

Neumann

[11] Patent Number: 5,503,592

[45] Date of Patent: Apr. 2, 1996

[54] GEMSTONE WORKING APPARATUS

[75] Inventor: Hillel Neumann, Ramat Hasharon, Israel

[73] Assignee: Turbofan Ltd., Ramat Gan, Israel

[21] Appl. No.: 292,137

[22] Filed: Aug. 17, 1994

Related U.S. Application Data

[63] Continuation-in-part of Ser. No. 190,826, Feb. 2, 1994, abandoned.

[51] Int. Cl.[6] ..... B24B 7/00

[52] U.S. Cl. ..... 451/278; 451/41; 451/57; 451/548; 451/461

[58] Field of Search ..... 451/41, 57, 58, 451/59, 538, 539, 548, 550, 461, 278

[56] References Cited

U.S. PATENT DOCUMENTS

| | | | |
|---|---|---|---|
| 2,309,016 | 1/1943 | Ryan . | |
| 3,841,031 | 10/1974 | Walsh | 51/283 |
| 4,955,162 | 9/1990 | Jackson | 51/283 R |

OTHER PUBLICATIONS

IBM Technical Disclosure: *By Hause* "Wafer–Polishing Process", Feb. 1978, vol. 20, No. 9 p. 3424.

*Primary Examiner*—Bruce M. Kisliuk

*Assistant Examiner*—Eileen P. Morgan

*Attorney, Agent, or Firm*—Townsend and Townsend and Crew

[57] ABSTRACT

Gemstone working apparatus which includes a rotatable base, one or more two gemstone working members including a first gemstone working member which defines a first gemstone working surface adapted for removable mounting on the base; and a second gemstone working member which defines a second gemstone working surface, of a different grain size than that of the first gemstone working surface, adapted for removable mounting on the base concentrically with the first gemstone working member; and rotational height adjustment apparatus for adjustment of the height of the second gemstone working member by rotation thereof relative to the first gemstone working member to any non-predetermined rotational position, thereby to bring the second working surface into planar alignment with the first working surface so as to provide a combination abrasive surface of varying grain size and of uniform level.

18 Claims, 5 Drawing Sheets

GEMSTONE WORKING APPARATUS

RELATED APPLICATIONS

This application is a continuation-in-part of U.S. patent application Ser. No. 08/190,826, filed Feb. 2, 1994, now abandoned.

FIELD OF THE INVENTION

The present invention relates to gemstone working in general, and, in particular, to gemstone cutting and polishing.

BACKGROUND OF THE INVENTION

Cutting and polishing of gemstones, including diamonds, other precious stones and semi-precious stones is well known. Gemstone working apparatus typically takes the form of a rotatable disk, known as a scaife or a lap, which has a planar working surface in which is embedded an abrasive of a preselected grade. A preferred abrasive is diamond dust.

Initial formation or 'cutting' of facets on a gemstone is performed by use of a relatively coarse abrasive, while fine finishing or 'polishing' is performed by use of a relatively fine abrasive.

As the operations of cutting and polishing require different grades of abrasive, it is known to provide two separate working surfaces. Each working surface has embedded therein an abrasive of a preselected grade and is located at a separate work station. Accordingly, after all the facets have first been cut on a gemstone at a first work station employing a relatively coarse abrasive, the gemstone may then be transferred to a second work station employing a finer abrasive for polishing.

It is, however, also known to provide two different grade abrasives on a single working surface. In this arrangement, an abrasive of one grade is provided on a first, circular area of the working surface, and an abrasive of a different grade is provided over a second, generally ring-like area of the working surface, concentric with the first area.

The described dual arrangement has the advantage of enabling working of a gemstone with abrasives of two different grades at a single work station. However, since the two different abrasives wear at different rates, this advantage is lost once the finer abrasive has worn down.

Disclosed in U.S. Pat. No. 2,309,016 to Ryan is a composite grinding wheel, "particularly . . . adapted for grinding tools which have hard cutting tips mounted on a metal shank" (column 1, lines 2–4). Ryan describes a wheel which has "two separate abrasive bodies for simultaneously grinding a composite work piece made of two different materials (column 2, lines 10–14). The two abrasive bodies are an annular outer body and a circular inner body. The inner body fits into the outer body via a pair of cooperating screw threads, the height of the inner body thus being adjustable relative to that of the outer body, by rotation of the inner body relative to the outer body.

The inner body may be locked in position in any of a predetermined plurality of rotational positions relative to the outer body. These positions are governed by provision of a plurality of screw holes that are formed in an inner portion of the inner body, a corresponding plurality of screw holes formed in a base or "cup" body, and a plurality of screws each adapted for insertion into a pair of axially aligned screw holes. The inner body may be locked to the base by insertion of the screws through the screw holes through both the inner body screw holes and the base screw holes.

It will thus be appreciated that the ability to adjust the height of the inner body relative to that of the outer body is limited in accordance with the number of screw holes provided, and that it is almost impossible to achieve a uniform height working surface, whereby the working surfaces of both the inner and outer bodies are in coplanar registration.

SUMMARY OF THE INVENTION

The present invention seeks to provide gemstone working apparatus having a working surface on which are provided more than one grade of abrasive, and of which at least one of the grades of abrasive is provided on a a disk-like element mounted onto a base, and whose height is adjustable relative to the base to any selectable height.

A further aim of the invention is to provide a novel method of performing successive working operations on a gemstone.

There is thus provided, in accordance with a preferred embodiment of the invention, gemstone working apparatus which includes a rotatable base, one or more two gemstone working members including a first gemstone working member which defines a first gemstone working surface adapted for removable mounting on the base; and a second gemstone working member which defines a second gemstone working surface, of a different grain size than that of the first gemstone working surface, adapted for removable mounting on the base concentrically with the first gemstone working member; and rotational height adjustment apparatus for adjustment of the height of the second gemstone working member by rotation thereof relative to the first gemstone working member to any non-predetermined rotational position, thereby to bring the second working surface into planar alignment with the first working surface so as to provide a combination abrasive surface of varying grain size and of uniform level.

Preferably, the height adjustment apparatus also includes apparatus for selectably securing the second gemstone working member in a selected, non-predetermined position relative to the base.

Additionally in accordance with a preferred embodiment of the invention, the second gemstone working surface is of a finer grain than that of the first gemstone working surface.

Further in accordance with a preferred embodiment of the invention, the second gemstone working member is adapted for rotation relative to the base, and the apparatus for selectable adjustment of height includes apparatus for adjusting the height of the second gemstone working member in response to rotation thereof.

Additionally in accordance with a preferred embodiment of the invention, the first gemstone working member has a disk-like configuration and the gemstone working surface thereof is a first gemstone working surface, the working member also defining a second gemstone working surface on a reverse side thereof.

Preferably, a supply of liquid coolant, preferably water, is provided for cooling the gemstone.

There is also provided, in accordance with a further preferred embodiment of the invention, a method of performing a sequence of gemstone working operations without requiring realignment of the gemstone between operations, the method comprising the following steps:

aligning a gemstone so as to have a selected angular alignment relative to a combination gemstone working surface having at least first and second contiguous coplanar abrasive portions of predetermined different grades of abrasive material;

working the selected gemstone portion on the first portion of the gemstone working surface;

while maintaining the angular alignment of the gemstone relative to the gemstone working surface, transferring the selected gemstone portion to be worked from the first portion to the second portion of the second portion of the gemstone working surface; and working the selected gemstone portion on the second portion of the gemstone working surface.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

The present invention relates to gemstone working apparatus having a number of particular features, and to a method of gemstone working. First, the apparatus includes at least two different concentric gemstone working members, each defining a different gemstone working surface. Second, at least one of these working members is arranged for adjustment of the height thereof as required due to wear of the abrasive material thereon. Preferably, work surface cooling means, such as water cooling means, are provided.

Figure 2:
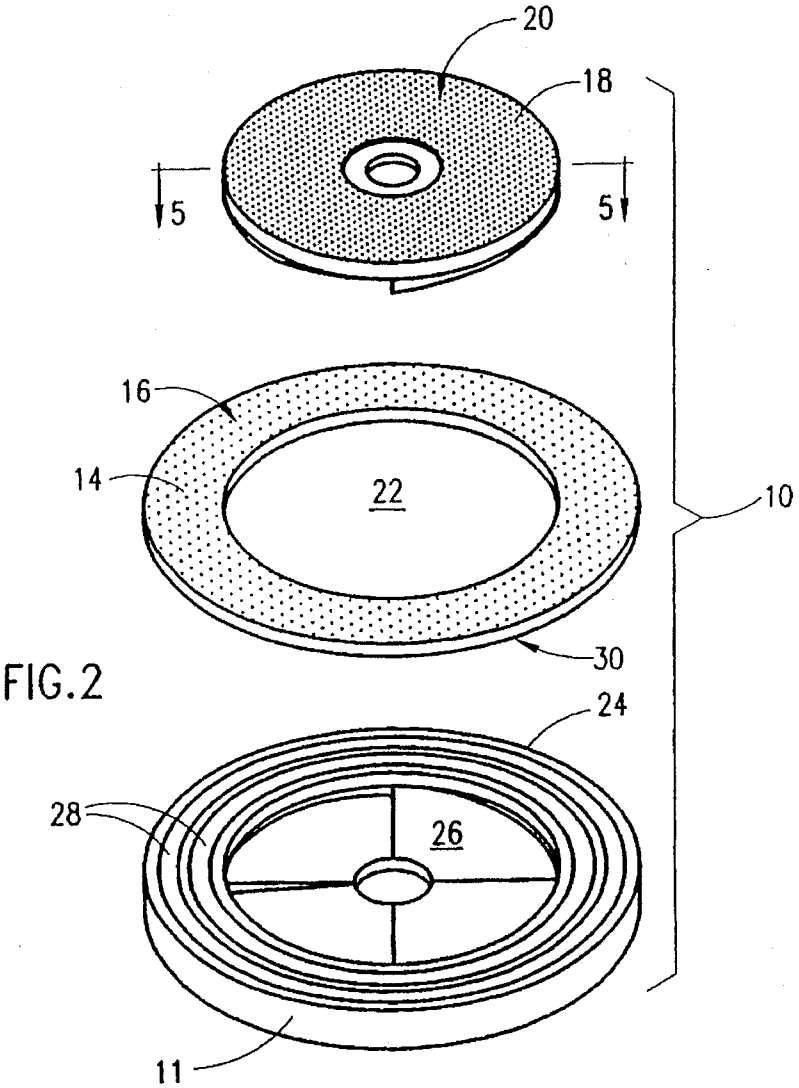
FIG. 2 is an exploded view of the gemstone working apparatus of FIG. 1.
Figure 1:
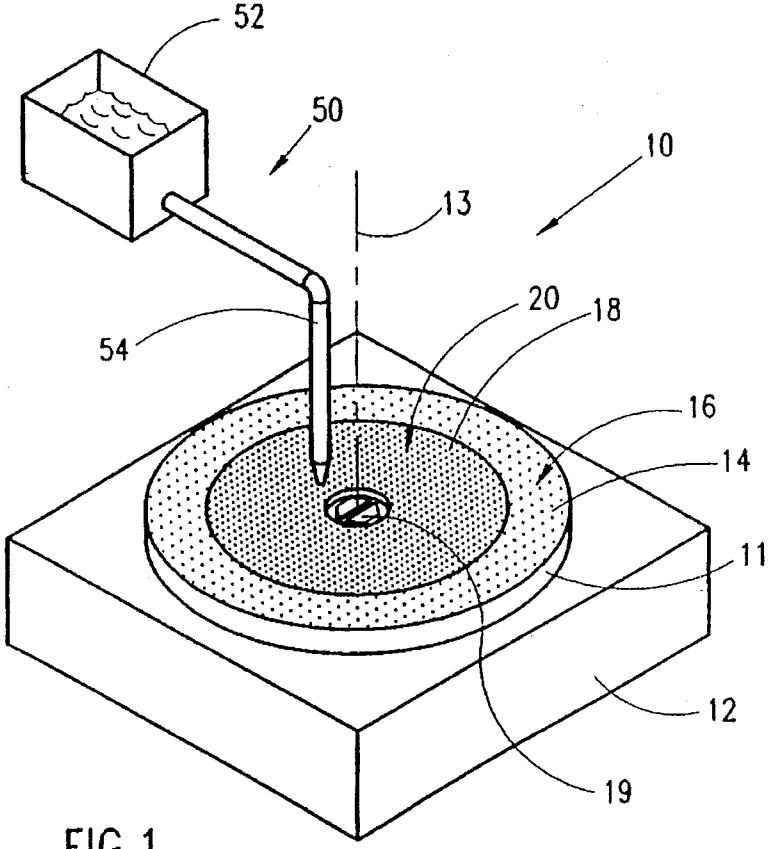
FIG. 1 is a schematic illustration of gemstone working apparatus constructed in accordance with an embodiment of the present invention.

Reference is now made to FIGS. 1 and 2, in which is illustrated gemstone working apparatus, referenced generally 10, constructed in accordance with a preferred embodiment of the present invention. Apparatus 10 includes a base 11 which is mounted onto a support 12 and is adapted for rotation about an axis 13 (FIG. 1) which extends therethrough, a first gemstone working member 14 which defines a first gemstone working surface 16, and a second gemstone working member 18 which defines a second gemstone working surface 20. Support 12 typically includes a drive member 25 (FIGS. 3B and 4B) for seating base 11, and a motor (not shown) for providing selectable rotation of drive member 25 and therefore, of base 11 and working members 14 and 18. Second gemstone working member 18 is fastened to drive member 25 through an opening in base 11 preferably by a threaded fastener 19. As seen in FIGS. 3B and 4B, screw 19 has a thread 21 which cooperates with a bore 23 formed in drive member 25 so as to selectably fasten second gemstone working member 18 thereto.

Each of the working surfaces 16 and 20 is an abrasive surface containing abrasive of a preselected grain size, formed by embedding therein an abrasive material, such as diamond dust, of a preselected grade.

According to an embodiment of the invention, first working surface 16 is of greater grain size than second working surface 20. According to this embodiment, first working surface may be suitable for cutting facets on gemstones, while second working surface 20 may be suitable for fine polishing of the cut facets.

First working member 14 preferably has a ring- like configuration, defining a central opening 22 (FIG. 2), and is adapted for mounting onto a first seating portion 24 (FIG. 2) of base 11. Second working member 18 is preferably circular and is constructed so as to fit into opening 22 of first working member 14, and is adapted for mounting onto a second seating portion 26 of base 11.

First working member 14 is adapted for removable mounting onto first seating portion 24 of base 11. According to a preferred embodiment of the invention, first working member 14 is made from a ferromagnetic material and, as seen in FIGS. 2, 3B and 4B, is preferably fastened to base 11 via a plurality, typically a pair, of magnetic strips or rings 28 embedded in the surface of the base. The use of magnetic strips 28 not only provides a secure mounting of working member 14 on base 11 but also enables provision of an abrasive surface 18 without fastener apertures. Alternatively, first working member can be made of any other suitable material and releasably affixed to base 11 in any conventional manner, including glue, screws or other fasteners.

Further in accordance with a preferred embodiment of the invention, first working member 14 has an additional working surface of preselected grain size on its reverse side 30 (FIG. 2). According to this embodiment, therefore, once one working surface of first working member 14 has worn down, it may simply be reversed and returned to first seating portion 24 of base 11, thereby enabling virtually uninterrupted use of apparatus 10.

According to another preferred embodiment, working surface cooling means 50 is provided. Cooling means 50 includes a liquid reservoir 52, which can include water, oil or other suitable cooling liquid, and means 54 for dripping liquid from the reservoir near the center of the gemstone working apparatus. Centrifugal force serves to move the liquid over the entire working surface. While the use of a cooling liquid when cutting and polishing certain gemstones is known, according to the invention water or other liquid cooling is preferably provided during the cutting and polishing of diamonds as well. It was thought in the past that the heat generated in the diamond during polishing was beneficial to the finished stone. It has now been discovered, however, that the finished stone is of better quality when it is cooled during cutting and polishing.

Figure 1A:
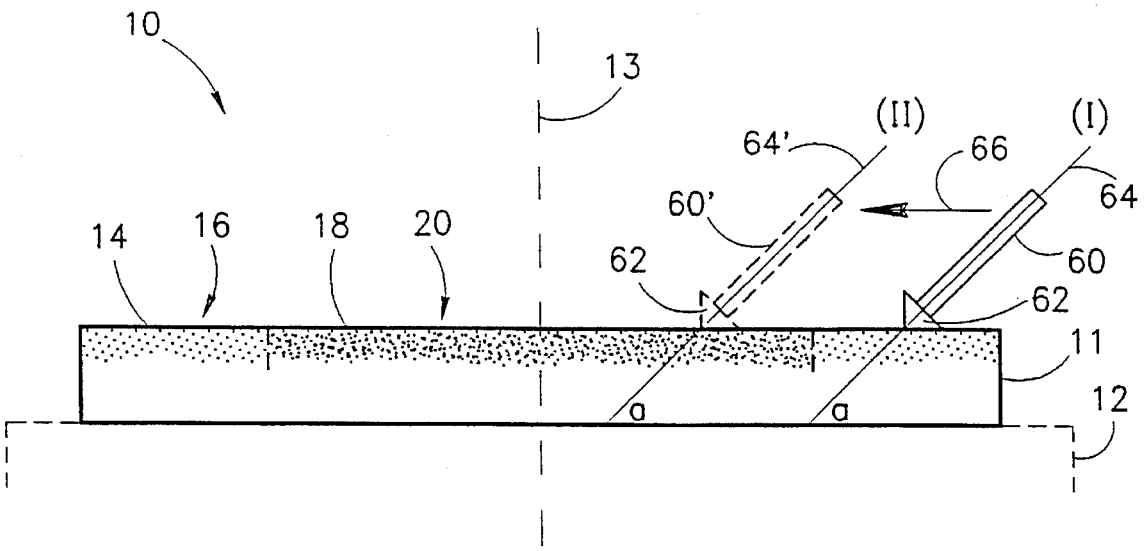
FIG. 1A is a schematic side view of the apparatus of FIG. 1, illustrating a method of the invention.

Referring now to FIG. 1A, an advantage of the provision of a combination gemstone working surface having at least first and second contiguous coplanar abrasive portions, referenced 14 and 18, of predetermined different grades of abrasive material, is that a sequence of gemstone working operations may be performed without requiring realignment of the gemstone between operations.

In the present example, it is seen that in a first position, seen at (I) in full lines, a dop 60 has mounted onto an end thereof a gemstone 62. Gemstone 62 may be a diamond or any other precious or semi-precious stone. The dop 60 is oriented such that its longitudinal axis 64 defines an angle a with the working surface.

In accordance with a method of the invention, the gemstone 62 is worked on the working surface 16 of the first working member of portion 14, thereby to initially work a facet of the gemstone. Subsequently, and while maintaining the angular orientation of dop 60 with the work surface, the gemstone 62 is moved laterally, as indicated by an arrow 66, from first position (I) to a second position (II), shown in broken lines, thereby to enable further working of the gemstone facet on work surface 20 of gemstone working member or portion 18.

It will be appreciated that this method minimizes the time taken between different working operations in forming a single facet on a gemstone. This is due, inter alia, to the fact that, as the gemstone does not have to be transferred to a different apparatus in order to complete the polishing, valuable time is saved by not having to realign the gemstone so as to find the particular facet sought to be polished.

Referring now to FIGS. 3A–4C, there is shown in respective plan, cross-sectional and enlarged cross-sectional views a portion of the gemstone working apparatus of the invention. It can be that the respective working members 14 and 18 are arranged on base 11 in a concentric arrangement so as to provide a combination abrasive surface, indicated generally by reference numeral 32 (FIG. 3B) of varying grain size and at a uniform level.

As will be appreciated by persons skilled in the art, an advantage of providing a single surface with two or more grades of abrasive is that two or more gemstone working operations can be performed without requiring transfer of the gemstone being worked from one work station to another. This not only saves space, but saves substantial time in that the stone need not be realigned between cutting and polishing. Thus, as long as the uniform level of the entire surface is maintained, no adjustment in the height of the worked stone relative to the working surface needs to be provided during a transition between the first working surface and the second working surface.

In practice, it is known that finer grain working surfaces wear faster than coarser grain surfaces. Accordingly, a compensatory height adjustment is required to the working surface which wears faster than the other working surface. This will generally be the inner working surface, since cutting with the coarser abrasive is done in such a way that the removed pieces of stone do not damage the outer work surface.

In the illustrated embodiment, the working surface 20 of second working member 18 tends to wear more quickly than first working surface 16. Accordingly, and in accordance with a preferred embodiment of the invention, in order to maintain a generally uniform level of the combination working surface 32 (FIG. 3B), second working member 18 is adapted for height adjustment relative to base 11 and, therefore, relative to first working member 14.

Figure 6:
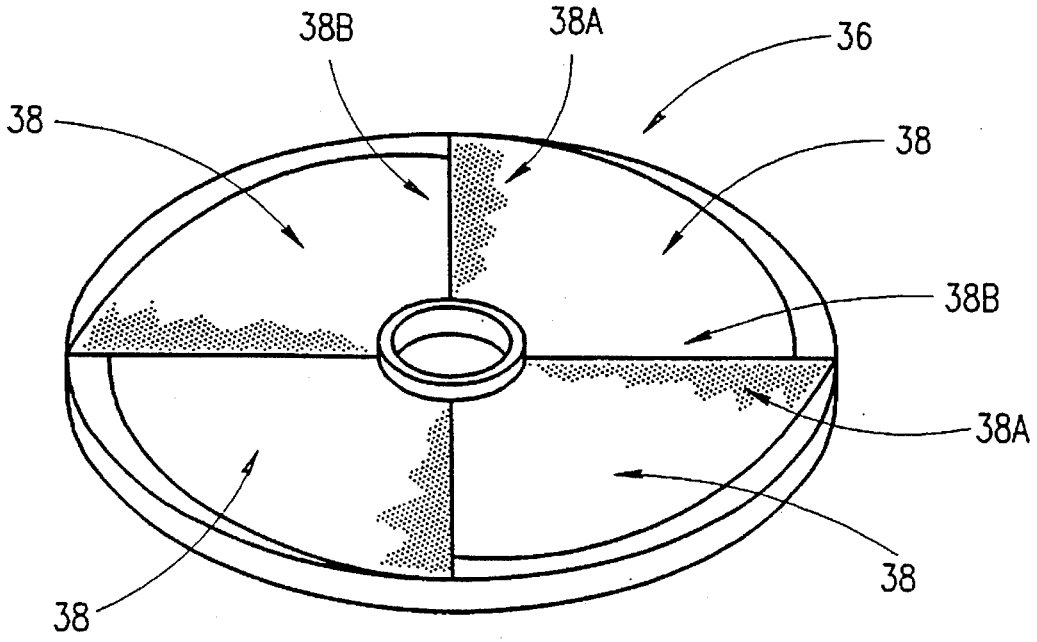
FIG. 6 is a schematic illustration of the lower side of the height adjustable working member of illustrated FIG. 5, taken in the direction of arrow 6 therein.

In accordance with the illustrated preferred embodiment of the invention, second seating portion 26 (FIG. 2) of base 11 defines a plurality of first stepped portions 34 (FIGS. 3B, 3C, 4B and 4C). Referring now additionally to FIGS. 5 and 6, it is seen that bottom side 36 of second working member 18 defines a plurality of second stepped portions 38. Second stepped portions 38 correspond to and are adapted to fit together with first stepped portions 34 of base 11. It will be appreciated by those skilled in the art that, while stepped portions 34 and 38 are illustrated as being substantially planar, in reality they are somewhat curved due to the ramp-like nature of the steps.

First stepped portions 34 of base 11 are separated by steps 35 (FIGS. 3A, 4A) so as to define recessed and raised portions, respectively referenced 34A and 34B. Second stepped portions 38 of second working member 18 are separated by steps 39 so as to define recessed and raised portions, respectively referenced 38A and 38B (FIGS. 3, 4, 3C and 4C). The relative positions of steps 35 and 39 are shown diagrammatically in FIGS. 3A and 4A by broken and full lines respectively. The recessed and raised portions 38A and 38B of second stepped portions 38 are configured to fit together with the raised and recessed portions 34B and 34A of each of the first stepped portions 34.

Figure 3A:
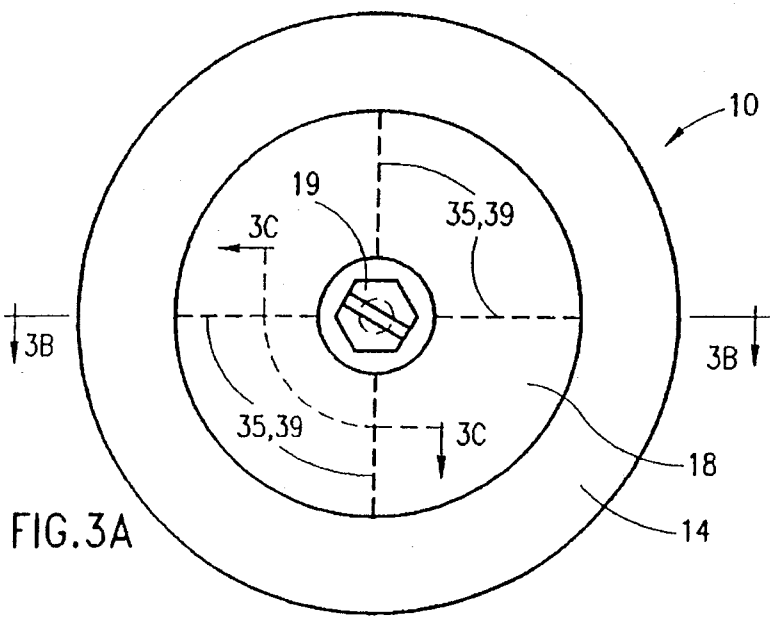
FIG. 3A is a diagrammatic plan view of the gemstone working apparatus of the present invention wherein the height adjustable working member thereof is in a relatively lowered position.
Figure 3B:
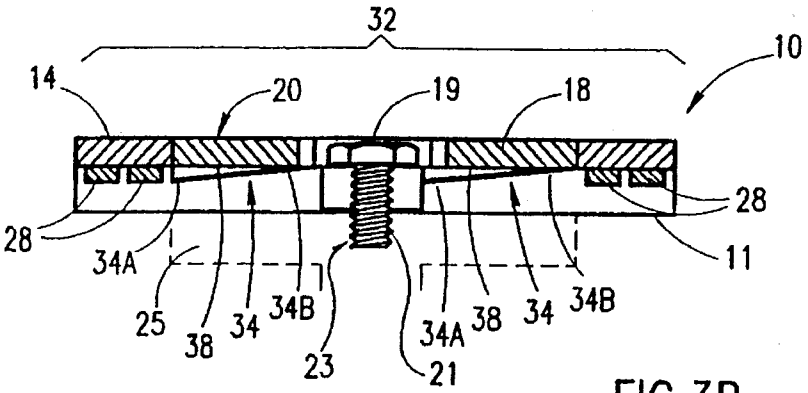
FIG. 3B is a cross-sectional view of the apparatus of FIG. 3A, taken along line 3B—3B therein.
Figure 3C:
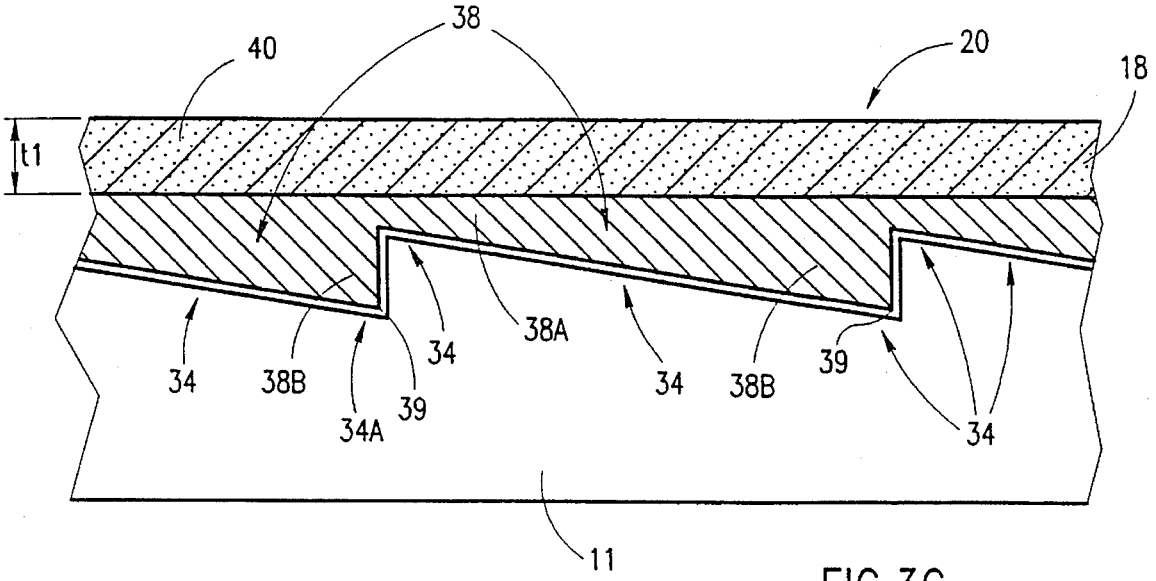
FIG. 3C is an enlarged sectional view of a portion of the apparatus of FIG. 3A, taken along line 3C—3C therein.

Referring now particularly to FIGS. 3A–3C, it is seen that when the first and second stepped portions 34 are fully engaged with second stepped portions 38, such that steps 39 are fully engaged with recessed portions 34A, and recessed portions 38A are fully engaged with steps 35, second working member 18 is at a minimum elevation relative to base 11. This ensures that the respective levels of working surfaces 16 and 20 of first and second working members 14 and 18 are uniform prior to substantial use thereof, as shown in FIG. 3B. At this stage, an abrasive layer 40 (FIG. 3C) of second working member 18 has a thickness 't1'.

Figure 4A:
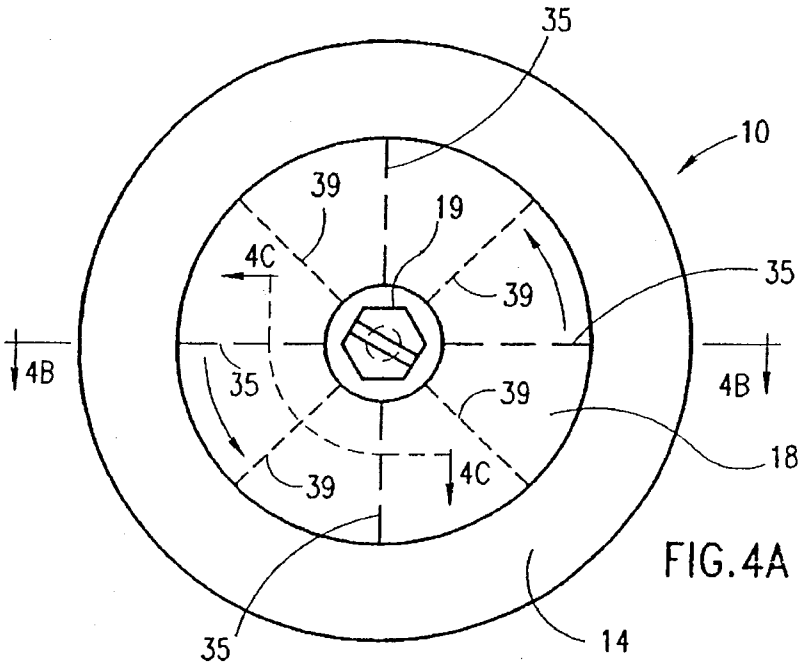
FIG. 4A is a diagrammatic plan view of the working gemstone apparatus of the present invention wherein the height adjustable working member thereof is in a relatively raised position.
Figure 4B:
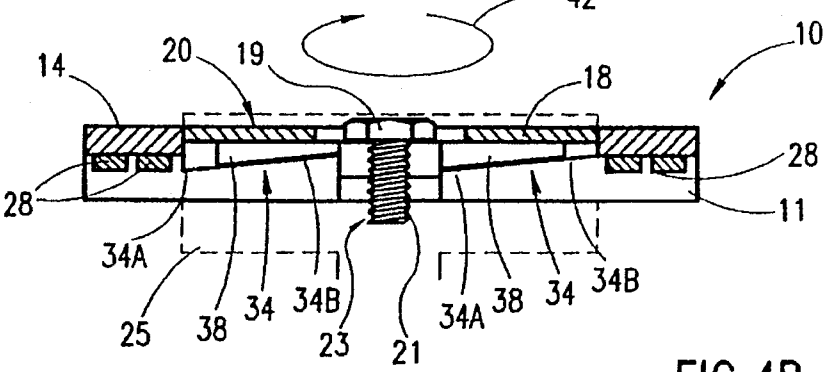
FIG. 4B is a cross-sectional view of the apparatus of FIG. 4A, taken along line 4B—4B therein.
Figure 4C:
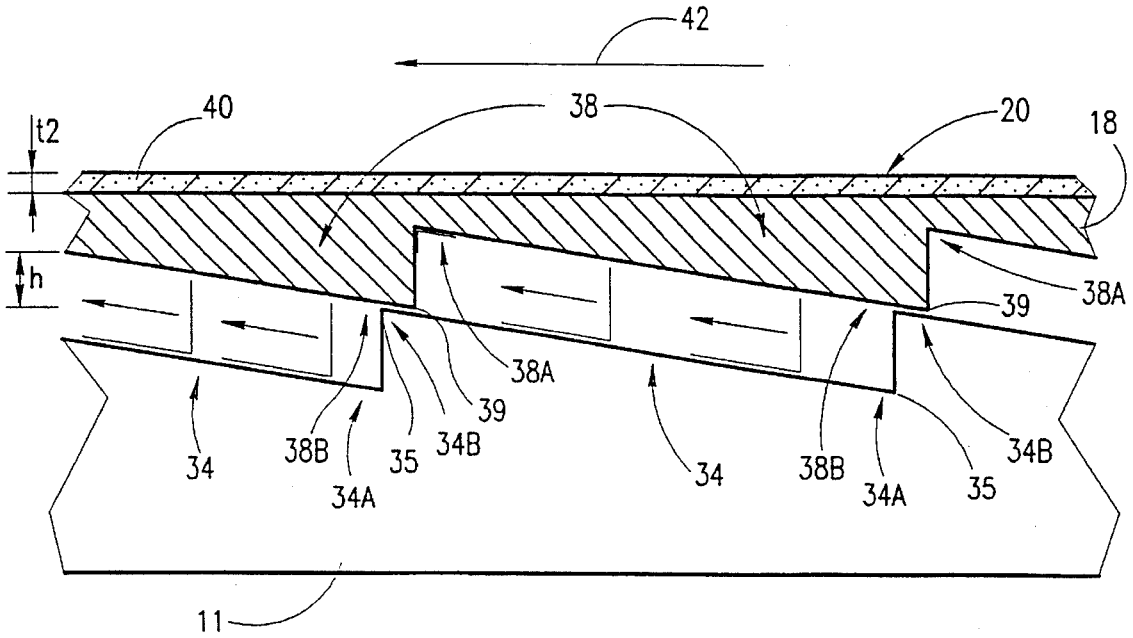
FIG. 4C is an enlarged sectional view of a portion of the apparatus of FIG. 4A, taken along line 4C—4C therein.
Figure 5:
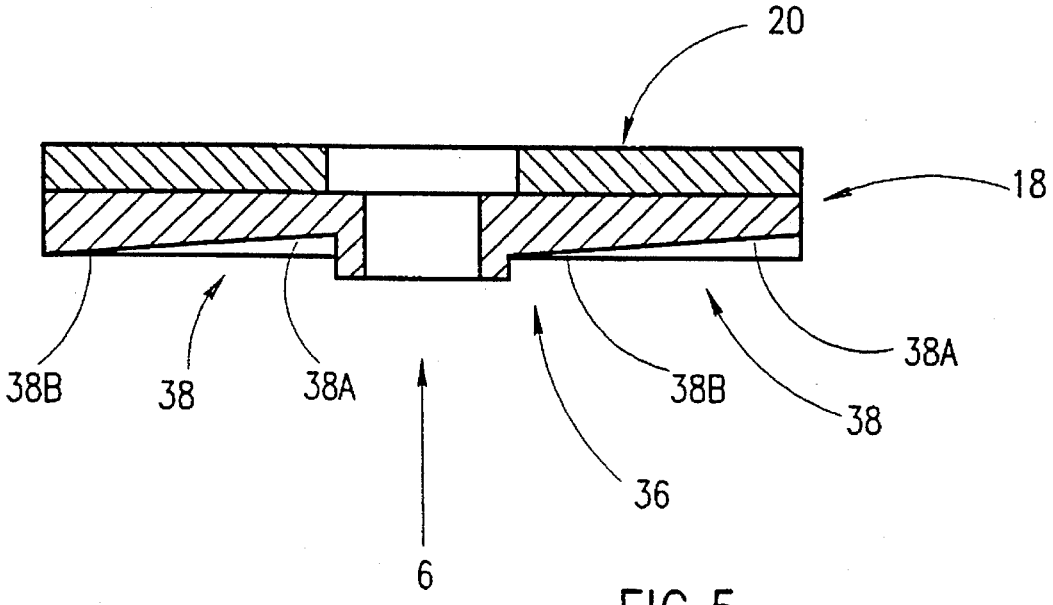
FIG. 5 is a cross-sectional illustration of a height adjustable member illustrated in FIG. 2, taken along the line 5—5 therein.

Referring now to FIGS. 4A–4C, it is seen that, after a period of use, the thickness of abrasive layer 40 (FIG. 4C) has been worn to 't2', and that in order to maintain the uniform level of the combination working surface, it is necessary to elevate second working member 18 relative to the first working member 14. This is done by loosening fastener 19 and, thereafter, rotating the second working member 18 relative to base 11, as described below. Fastener 19 is subsequently retightened so as to securely fasten second working member 18 in the selected rotational position relative to the base 11.

Due to the stepped configurations of the second seating portion 26 of base 11 and of the bottom side 36 of second working member 18, a partial rotation of the second working member 18 relative to base 11, indicated by arrow 42 (FIGS. 4B and 4C) causes an elevation of second working member 18 relative to base 11 and, correspondingly, relative to first working member 14, to the position shown most clearly in FIG. 4C. It will be appreciated that elevation of any desired degree can be provided so that at the first sign of wear, the height can be readjusted to provide substantially continual alignment of the two working surfaces.

As shown in FIG. 4C, a maximum increase of 'h' in the level of working surface 20 of second working member 18 relative to base 11 is provided upon rotation of second working member 18 to a position whereat the first and second stepped portions 34 and 38 are in minimal engagement. In this position, the second working member 18 is supported on second seating portion 26 of base 11 solely by the engagement of the steps 35 of base 11 with steps 39 of second working member 18. At this stage, a further rotation of second working member 18 relative to base 11 will cause steps 39 to engage recessed portions 34A thereof, causing a return of second working member 18 to the position shown in FIG. 3C. Subsequently, the worn second working member 18 can be replaced by a fresh second working member, thereby to enable continued use of the apparatus of the invention.

It will be appreciated by persons skilled in the art that, although height adjustment of the second working member 18 relative to base 11 has been described above as being facilitated by the provision of stepped portions on base 11 and on the bottom side of second working member 18, any other alternative suitable means for achieving selectable height adjustment can alternatively be employed.

A major advantage of the present invention is the fact that, due to the use of stepped height adjustment means and a single, centrally positioned fastener 19, second gemstone member 18 can be optimally adjusted. That is, rotationally elevating member 18 to exactly that position which will provide the correct elevational alignment of second work surface 20 relative to first work surface 16.

It will be appreciated by those skilled in the art that the working members will need to be replaced as the working surfaces thereon wear down, as known in conventional laps and scaifes. The working members of fixed height generally have a thin layer of abrasive material and are removed and replaced when the abrasive material is worn. The working members of adjustable height have a plurality of layers or a thicker layer of abrasive material and so can be used until the all the abrasive material has worn off.

According to an alternate embodiment of the invention, the gemstone working apparatus includes more than two concentric working members. This is useful particularly with very large stones. It will be appreciated that of these working members, at least one, and possibly more, are of fixed height, and at least one, and possibly more, are of adjustable height, most preferably independently of one another.

A particular feature of this invention is the versatility in the choice of working surfaces which can be employed, depending upon the particular stone to be worked. Thus, for example, for an apparatus having two working members, a plurality of outer rings of varying coarse grain sizes, and a plurality of inner rings of varying fine grain sizes can be made of the suitable size. From these, the desired combination of cutting and polishing grain can be selected for each stone.

It will be further be appreciated by persons skilled in the art that the scope of the present invention is not limited to what has been shown and described hereinabove by way of example. Rather, the scope of the invention is limited solely by the claims, which follow.

I claim:

1. Gemstone abrading apparatus which comprises:

a rotatable base;

at least two gemstone abrading members including:

a first gemstone abrading member which defines a first gemstone abrading surface and which is removably mountable onto said base; and a second gemstone abrading member which defines a second gemstone abrading surface, of a different grain size than that of said first gemstone abrading surface, and which is removably mountable onto said base concentrically with said first gemstone abrading member; and rotational height adjustment means for adjustment of the height of said second gemstone abrading member by rotation thereof relative to said first gemstone abrading member to any non-predetermined-rotational position, thereby to bring said second abrading surface into planar alignment with said first abrading surface so as to provide a combination abrading surface of varying grain size and of uniform level;

said height adjustment means, including:

first stepped means provided in said base;

second stepped means provided on said second abrading member for engaging said first stepped means; and means for selectably securing said second gemstone abrading member in a selected, non-predetermined rotational position relative to said base, wherein said first stepped means defines recessed portions and raised portions and said second stepped means defines raised portions and recessed portions corresponding to said recessed and raised portions of said first stepped means, and wherein, in a relatively lowered position, said raised and recessed portions of said second stepped means respectively engage said recessed and raised portions of said first stepped means, and wherein rotation of said second abrading member relative to said base causes said raised portions of said second stepped means to engage said raised portions of said first stepped means, thereby to raise said second gemstone abrading member relative to said base.

2. Apparatus according to claim 1, and herein said second gemstone abrading surface is said first gemstone abrading of a finer grain than that of surface.

3. Apparatus according to claim 1, and wherein said first gemstone abrading member comprises a ferromagnetic material, and magnetic means mounted in association with said base for removable mounting.

4. Apparatus according to claim 3, and wherein said magnetic means comprises at least one magnetic strip embedded in a surface of said base.

5. Apparatus according to claim 4, and wherein said at least one magnetic strip comprises at least one magnetic ring.

6. Apparatus according to claim 1, and wherein said first gemstone abrading member has a disk-like configuration and said gemstone abrading surface thereof is a generally planar first gemstone abrading surface, and said first gemstone abrading member also defines an additional gemstone abrading surface on a reverse side thereof.

7. Apparatus according to claim 1, and further comprising liquid cooling means for cooling said gemstone abrading surfaces.

8. Apparatus according to claim 7, and wherein said cooling means comprises a liquid reservoir and means coupled to said liquid reservoir for dripping liquid from said reservoir onto said gemstone abrading apparatus.

9. Apparatus according to claim 7, and wherein said liquid cooling means comprises water cooling means.

10. Abrading apparatus which comprises:

a rotatable base;

at least two abrading members including a first abrading member which defines abrading surface and which is removably mountable onto said base;

a second abrading member which defines a second abrading surface, of a different grain size than that of said first abrading surface, and which is removably mountable onto said base concentrically with said first abrading member; and rotational height adjustment means for adjustment of the height of said second abrading member by rotation thereof relative to said first abrading member to any non-predetermined rotational position, thereby to bring said second abrading surface into planar alignment with said first abrading surface so as to provide a combination abrading surface of varying grain size and of uniform level;

said height adjustment means including:

first stepped means provided in said base;

second stepped means provided on said second abrading member for engaging said first stepped means; and means for selectably securing said second abrading member in a selected, non-predetermined rotational position relative to said base, wherein said first stepped means defines recessed portions and raised portions and said second stepped means defines raised portions and recessed portions corresponding to said recessed and raised portions of said first stepped means, and wherein, in a relatively lowered position, said raised and recessed portions of said second stepped means respectively engage said recessed and raised portions of said first stepped means, and wherein rotation of said second abrading member relative to said base causes said raised portions of said second stepped means to engage said raised portions of said first stepped means, thereby to raise said second abrading member relative to said base.

11. Apparatus according to claim 10, and wherein said second abrading surface is of a finer grain than that of said first abrading surface.

12. Apparatus according to claim 10, and wherein said first abrading member comprises a ferromagnetic material, and magnetic means mounted in association with said base for removable mounting.

13. Apparatus according to claim 12 wherein said magnetic means comprises at least one magnetic strip embedded in a surface of said base.

14. Apparatus according to claim 13 wherein said at least one magnetic strip comprises at least one magnetic ring.

15. Apparatus according to claim 10, and wherein said first abrading member has a disk-like configuration and said abrading surface thereof is a generally planar first abrading surface, and said first abrading member also defines an additional abrading surface on a reverse side thereof.

16. Apparatus according to claim 10, and further comprising liquid cooling means for cooling said surfaces.

17. Apparatus according to claim 16, and wherein said cooling means comprises a liquid reservoir and means coupled to said liquid reservoir for dripping liquid from said reservoir onto said abrading apparatus.

18. Apparatus according to claim 16 wherein said liquid cooling means comprises water cooling means.

* * * * *

UNITED STATES PATENT AND TRADEMARK OFFICE

CERTIFICATE OF CORRECTION

PATENT NO. : 5,503592

DATED : April 2, 1996

INVENTOR(S) : Hillel Neumann and Ramat Hasharon

It is certified that error appears in the above-indentified patent and that said Letters Patent is hereby corrected as shown below:

Column 8:

Claim 2, line 1 please delete [herein] and substitute wherein.

Claim 2, line 2 after "is" please insert of a finer grain than that of.

Claim 2, line 2-3 after "abrading" please delete [of a finer grain than that of].

Claim 10, line 4 please insert a first before "abrading surface".

Signed and Sealed this

Sixth Day of August, 1996

*Attest:*

*Attesting Officer*

BRUCE LEHMAN

*Commissioner of Patents and Trademarks*